United States Patent [19]

Schnur et al.

[11] 4,097,317

[45] Jun. 27, 1978

[54] DESENSITIZING AGENT FOR COMPOSITIONS CONTAINING CRYSTALLINE HIGH-ENERGY NITRATES OR NITRITES

[75] Inventors: Joel M. Schnur, Springfield, Va.; Richard S. Miller, Crofton, Md.; James P. Sheridan, Burke; A. D. Britt, Alexandria, both of Va.

[73] Assignee: The United States of America as represented by the Secretary of the Navy, Washington, D.C.

[21] Appl. No.: 781,278

[22] Filed: Mar. 25, 1977

[51] Int. Cl.[2] ..... C06B 45/34; C06B 25/34; C06B 45/06

[52] U.S. Cl. ..... 149/7; 149/92; 149/18; 149/88; 149/19.92; 149/19.1; 149/46

[58] Field of Search ..... 149/19.1, 88, 18, 11, 149/92, 7, 19.9, 19.92

[56] References Cited

U.S. PATENT DOCUMENTS

| | | | |
|---|---|---|---|
| 3,108,916 | 10/1963 | Coffe | 149/11 |
| 3,138,496 | 6/1964 | Monical | 149/11 |
| 3,884,736 | 5/1975 | Stack | 149/92 |

*Primary Examiner*—Ronald H. Smith
*Assistant Examiner*—Sam Silverberg
*Attorney, Agent, or Firm*—R. S. Sciascia; Philip Schneider; Thomas McDonnell

[57] ABSTRACT

Increasing the stability of composite energetic compositions containing crystalline high-energy nitrates or nitrites by the inclusion of saligenin into the composition.

6 Claims, No Drawings

DESENSITIZING AGENT FOR COMPOSITIONS CONTAINING CRYSTALLINE HIGH-ENERGY NITRATES OR NITRITES

BACKGROUND OF THE INVENTION

This invention pertains generally to energetic gas producing compositions and in particularly to a desensitizer for composite energetic compositions with crystalline high-energy nitrates or nitrites.

Many solid propellants or explosive, catagorized as composites, comprise an oxidizer, a binder, and a number of other ingredients, e.g., metal fuels, catalysts, or age stabilizers. Crystalline high-energy nitrates or nitrites (CHEN) are often used as the oxidizer. Their cost is relatively low and their energy content is high. A major difficulty with these nitrates or nitrites is the ease with which they explode accidentially.

This property of energetic compositions is actually a matrix of factors. Sensitivity includes the reaction of the energetic compositions to mechanical shock, heat, pressure, friction or any other stress that can cause detonation. While an energetic composition can be more sensitive to one stress than another, such a conposition would detonate if any stress is severe enough. Desensitization is defined as the technique by which an explosive or propellant is rendered less reactive to these factors with a minimum of decrease in the other properties, e.g., specific impulse or age stability.

Desensitization is accomplished by the selection of certain materials for the binder and/or the inclusion of a desensitizing agent. The most widely used desensitizing binder material is certain microcrystalline waxes. Unfortunately, this type of wax is scarce and expensive.

SUMMARY OF THE INVENTION

It is, therefore, an object of this invention to provide a new desensitizer for explosive and propellant composition having crystalline high-energy nitrates or nitrites.

A further object of this invention is to provide a desensitizer which is capable of reducing the sensitivity of a large number of compositions having crystalline high-energy nitrates or nitrites without decreasing the energy of the composition.

Another object of this invention is to provide a desensitizing agent which is inexpensive and readily available.

These and other objects are achieved by coating the nitrate or nitrite crystals of a composite energetic composition with saligenin prior to compounding in an amount sufficient to provide a CHEN-to-saligenin weight from 1820:1 to 600:1 or by incorporating saligenin into the binder of a composite energetic composition in an amount sufficient to provide a nitrate-to-saligenin weight ratio from 182:1 to 45:1.

DETAILED DESCRIPTION OF THE INVENTION

The precise mechanism by which saligenin desensitize CHEN compositions is not known. It is postulated that the inclusion of saligenin increases the free-radical trapping of the binder. This conclusion is based on the observed correlation between the ability of known binders to trap free radicals and the effectiveness of that binder in desensitizing the composition. Other factors, such as lubrication, energy absorption, and shock absorption of the binder contribute to some degree to the desensitization of the composition. Although the precise mechanism of this invention can not at this moment be demonstrated, it can be demonstrated that the inclusion of saligenin in a CHEN composition improves significantly the stability of that composition.

Saligenin is suitable as a desensitizing agent for any propellant or explosive composition containing one or more crystalline high-energy nitrates. Examples of such materials are cyclotrimethylenetrinitramine (RDX), cyclotetramethylenetetranitramine (HMX), pentaerythritol tetranitrate (PETN), ammonium nitrate (AN), ditrinitroethylurea (DiTeU), and nitroguanidine.

Any wax or other binder material which has sufficient processability and viscoelasticity for propellant or explosive manufacture may be used with saligenin and sensitivity of the composition would be decreased. Exemplary of these materials are saturated alcohols with a molecular weight from 400 to 800, alkanes with a molecular weight from 400 to 800, saturated acids with a molecular weight from 350 to 750, saturated esters with a molecular weight of 350 to 750, mixtures of the foregoing, polyethylene, polyisoprene, polyureathane, unsaturated polyester resins crosslinked with styrene, vinyl polymers of the general formula:

$$CH_2{=}\underset{\underset{y}{|}}{CH}$$

wherein $y$ may be H, Cl, or COOH, and other thermoplastic, thermosetting, and/or crosslinked polymers Specific examples of wax binders are octadecyl terephthalate, N-octadecyl, O-docosanyl carbamate, 12-hydroxystearic acid, N-octadecyl N'-docosanyl urea, N-phenyl O-docosanyl carbamate, octadecyl stearate, docosanyl terephthalate, octadecyl succinate, resorcinyl docosanoate, docosanyl, 2-dodicon-1-yl succinate, p-hydroxy ethyl terephthalate, and hexadecanyl carbamate. The commercially obtained waxes are mixtures of compounds whose molecular weight may go as high as 3000.

Since saligenin is relatively chemically inert, the use of saligenin does not present any compatability problems with other ingredients commonly included into propellant or explosive compositions. Examples of additional ingredients are fuels, e.g., alunimum, zirconium or boron, or age stabilizers, e.g., squalene, or antifoam agents, e.g., dimethyl silicone.

The amount of saligenin to be added to a CHEN composition depends on the method of addition. If saligenin is added directly to the crystals prior to compounding, the CHEN-to-salgenin weight ratio if from 1820:1 to 600:1 and preferably from 1150:1 to 760:1. But if the saligenin is added to the binder prior to compounding the CHEN-to-saligenin weight ratio is from 182:1 to 45:1 and preferably from 120:1 to 60:1.

Saligenin is added to the crystals by either dissolving saligenin in a suitable solvent, e.g., methylene chloride or benzene, admixing the crystals with the solution, and evaporating the solvent, or melting the saligenin and admixing the crystals with the molten material. After the addition, compounding the composite energetic composition proceeds in the usual manner with any of the accepted techniques.

Saligenin is added to a wax binder by either admixing both in a suitable solvent, e.g., methylene chloride and removing the solvent or melting both and mixing. After the addition of saligenin, compounding the composite energetic composition is done in the usual manner with any of the accepted methods.

In order to demonstrate the utility of the present invention several composite explosives comprising RDX and a wax binder were tested. The test results as shown in Table 2. It is understood that these examples are given by way of demonstration and are not meant to limit this disclosure or the claims to follow in any manner.

Compositions 2–6 in Table 1 were prepared by melting the wax binder and saligenin together, mixing the two until a uniform distribution is obtained, admixing the treated wax with RDX by the hot slurry method at 85° for 3 hours, cooling, filtering, and drying the composition. In short, the compositions after the addition of saligenin were compounded in the method required for composition A3 explosives by the operating procedures of the U.S. Navy.

Compositions 7 and 8 in Table 1 were prepared by dissolving saligenin in methylene chloride, admixing the solution with RDX, evaporating methylene chloride, admixing the treated crystals with the wax binder by the hot slurry method at 85° C for 3 hours, cooling, filtering, and drying the composition.

TABLE 1

| | COMPOSITIONS | | |
|---|---|---|---|
| Ex. No. | RDX wt. % | Saligenin wt. % | Binder (wt. %) |
| 1 | 100 | | |
| 2 | 91 | 1 | 500 mw Sat. Alcohol (8) |
| 3 | 91 | 1 | 500 mw Sat. Acid (8) |
| 4 | 91 | 1 | $CH_3(CH_2)_{17}$—O—C—$(CH_2)_{16}CH_3$ (8) |
| 5 | 91 | 1 | 500 mw Sat. Alkane (8) |
| 6 | 91 | 2 | 500 mw Sat. Alkane (7) |
| 7 | 91 | 0.1 | 500 mw Sat. Alkane (8.9) |
| 8 | 91 | 0.5 | 500 mw Sat. Alkane (8.5) |

The sensitivity of a composition was tested by the Model 12 Impact Method which comprises placing the energetic composition on flint paper which is resting on a flat steel anvil and allowing a flat 1¼ inch plunger, which is attached to a 2.5 kg. weight, to drop upon the compound from a predetermined height. The sensitivity was then measured in terms of the height from which the dropping plunger initiated an explosion. Each composition of Table 1 was tested at least 30 times. A result given in Table 2 is the average of all tests conducted on a particular composition. Also given in Table 2 are the sensitivities of the compositions. without saligenin.

TABLE 2

| | TEST RESULTS | |
|---|---|---|
| Ex. No. | Height (cm) w/sal. | Height (cm) w/o sal. |
| 1 | | 22 |
| 2 | 58.1 | 54.2 |
| 3 | 58.6 | 54.2 |
| 4 | 63.2 | 52.4 |
| 5 | 58.1 | 49.3 |
| 6 | 58.1 | 49.3 |
| 7 | 63.0 | 49.3 |
| 8 | 43.0 | 49.3 |

The first point to note from Table 2 is that saligenin should be added in amounts specified previously. This is especially true when saligenin is incorporated by a direct addition onto the crystals.

As can be seen from Table 2, the addition of saligenin consistently provides a 10 to 20% improvement in the resistance of a composite CHEN composition to unwanted detonations. With such improvements, many waxes which are marginally effective from a safety viewpoint would be rendered substantially safe by the addition of saligenin. Consequently, many more waxes and other materials are now available as substitutes for the ever increasingly scarce microcrystalline waxes as binder materials. In addition, all composite energetic compositions with crystalline high-energy nitrates or nitrites are made more safe by the addition of saligenin.

Obviously many modifications and variations of the present invention are possible in light of the above teachings. It is therefore to be understood that within the scope of the appended clains the invention may be practiced otherwise than as specifically described.

What is claimed and desired to be secured by Letters Patent of the United States is:

1. In a method for desensitizing a composite energetic composition with high-energy nitrate or nitrite crystals the improvement which comprises coating said crystals, prior to compounding said composition with saligenin in a crystal-to-saligenin weight ratio from 1820:1 to 600:1.

2. The method of claim 1 wherein said weight ratio is from 1150:1 to 760:1.

3. The method of claim 1 wherein said weight ratio is from 910:1.

4. In a method for desensitizing a composite energetic composition comprising high-energy nitrate or nitrite crystals and a wax binder the improvement which comprises admixing saligenin with said wax binder prior to compounding said composition in an amount sufficient to provide in said composition a crystal-to-saligenin weight ratio from 182:1 to 45:1.

5. The method of claim 4 wherein said ratio is from 120:1 to 60:1.

6. The method of claim 4 wherein said ratio is 91:1.

* * * * *